US006997439B2

(12) United States Patent
Miyazaki et al.

(10) Patent No.: US 6,997,439 B2
(45) Date of Patent: Feb. 14, 2006

(54) LIQUID FILLING VALVE

(75) Inventors: Kazuo Miyazaki, Tokyo (JP); Norimi Kawanami, Tokyo (JP); Takao Katayama, Tokyo (JP); Hitoshi Takaku, Tokyo (JP); Yukinobu Nishino, Ishikawa-ken (JP); Futoshi Konishi, Ishikawa-ken (JP)

(73) Assignees: Dai Nippon Printing Co., Ltd., Tokyyo (JP); Shibuya Kogyo Co., Ltd., Ishikawa-ken (JP)

( * ) Notice: Subject to any disclaimer, the term of this patent is extended or adjusted under 35 U.S.C. 154(b) by 67 days.

(21) Appl. No.: 10/745,404

(22) Filed: Dec. 22, 2003

(65) Prior Publication Data

US 2004/0188652 A1 Sep. 30, 2004

(30) Foreign Application Priority Data

Dec. 25, 2002 (JP) ..... 2002-374558

(51) Int. Cl.
*B67C 3/28* (2006.01)

(52) U.S. Cl. ..... 251/324; 251/63; 251/63.5; 141/146

(58) Field of Classification Search ..... 251/62–63.6, 251/324; 141/145, 146

See application file for complete search history.

(56) References Cited

U.S. PATENT DOCUMENTS 1,373,599 A * 4/1921 Clark ..... 137/596.18
1,540,962 A * 6/1925 Stuart ..... 137/112
5,954,086 A * 9/1999 Ronchi ..... 137/244

FOREIGN PATENT DOCUMENTS

JP 09-255095 9/1997

* cited by examiner

*Primary Examiner*—J. Casimer Jacyna
(74) *Attorney, Agent, or Firm*—Flynn, Thiel, Boutell & Tanis, P.C.

(57) ABSTRACT

The present invention provides a filling valve which affords an excellent sterilization capability and a high maintenance capability. The valve includes a tubular nozzle 4, an operating rod 6 which is fitted in the nozzle 4 so as to be elevatable, and an opening/closing valve 22 formed by a valve seat 10*a* on the internal surface of the nozzle 4 at its bottom end and a valve element 6*a* formed at the bottom end of the operating rod 6. A portion 10*c* of a reducing diameter which gradually reduces the cross-sectional area of the filled liquid passage 10 in a downward direction and a portion 10*e* of an increasing diameter which gradually increases the cross-sectional area of the filled liquid passage 10 in the downward direction are formed on the internal surface of the nozzle 4 at an upper portion thereof. A plurality of straightening vanes 36 are formed on the internal surface of the nozzle 4 at a location below the portion 10*e* of an increasing diameter.

4 Claims, 2 Drawing Sheets

LIQUID FILLING VALVE

BACKGROUND OF THE INVENTION AND RELATED ART STATEMENT

The present invention relates to a liquid filling valve which is used to fill a vessel with a liquid, and in particular, to the construction of a filled liquid passage which is formed inside the valve.

A liquid filling valve generally comprises a pipe-shaped nozzle having a liquid pouring port at its bottom end, an operating rod passing through the nozzle in an elevatable manner and carrying a valve element toward its bottom end, and elevating means such as a cylinder which causes the operating rod to be driven up and down. By driving the operating rod down and up, the valve element which is carried by the operating rod at its bottom end can be caused to be seated upon a tapered valve seat which is formed in the bottom end of the filled liquid passage or to be removed therefrom, thus closing or opening the filled liquid passage.

In a conventional liquid filled valve as mentioned above, there has been a problem that at the commencement or termination of a filling operation, or immediately after the valve element has been removed from or immediately before the valve element is seated on the valve seat, the filled liquid passage is rapidly throttled to increase the flow speed of the liquid, causing a liquid splash or a bubbling within the vessel. In addition, in an above-the-mouth filling operation, there is also another problem that the splashed liquid may contaminate the outer surface of the vessel or the environment.

It is also to be noted that in the liquid filling valve as noted above, the operating rod is driven up and down through its connection with an air cylinder which is located above. Accordingly, a filled liquid (liquid to be filled) is introduced into the filled liquid passage through a lateral liquid feed pipe which is connected to the pipe-shaped nozzle. When a liquid is introduced laterally into the vertically disposed nozzle through which the operating rod extends centrally, the liquid flows down the filled liquid passage vortically to be filled into a vessel from the pouring port which is located toward the bottom end of the nozzle. There arises a problem then that the filled liquid is splashed around as it is projected from the pouring port as a vortical flow.

With a liquid filling valve as mentioned above where the liquid flowing out of the pouring port may be splashed, an above-the-mouth filling operation in which the filling operation takes place while maintaining the nozzle end above the mouth of the vessel is impossible. Where the liquid to be filled contains large particles as occurs in a fruit juice admixed with a pulp, the use of a metal meshwork to prevent a liquid splash is inhibited because the meshwork around the pouring port experiences a plugging.

The present inventor has previously filed a patent application for an invention which eliminates such difficulty (see Japanese Laid-Open Patent Application No. 9-255,095). In that invention, the valve comprises a tubular nozzle having an internal filled liquid passage, an operating rod passing through the tubular nozzle and driven up and down by elevating means, and an opening/closing valve including a valve element mounted on the bottom of the operating valve and a valve seat formed on the internal surface of the nozzle at the bottom end thereof. More specifically, the internal surface of the tubular nozzle has formed toward its top end a portion of a reduced diameter which gradually reduces the cross-sectional area of the filled liquid passage in a downward direction, and a portion of an increased diameter which is located below the portion of the reduced diameter and which gradually increases the cross-sectional area of the filled liquid passage in a downward direction. A portion of a constant internal diameter is formed on the internal surface of the nozzle in a region between the portion of the increased diameter and the opening/closing valve which is located therebelow, and a plurality of axially extending straightening vanes are mounted on the external surface of the operating rod which corresponds to the portion of a constant diameter.

According to the invention disclosed in the cited Laid-Open Patent Application, the liquid which flows down inside the nozzle in a vortical flow is completely straightend to remove a vortex before it is projected from the liquid pouring port, thus preventing the liquid from being splashed around, suppressing an increase in the flow speed to prevent a liquid splash and also preventing a bubbling within the vessel.

However, according to the arrangement of the described invention, the internal surface of the nozzle is formed with a portion of a reduced diameter, through which the operating rod having straightening vanes mounted on its external surface extends. Accordingly, when the operating rod is to be withdrawn from within the nozzle for purpose of maintenance such as changing bellows, the operating rod must be constructed so that it can be disassembled into a plurality of portions. At this end, in the filling valve mentioned above, the operating rod comprises a plurality of members, which are connected together by threadable engagement.

However, when the operating rod comprises a plurality of members, which are connected together by threadable engagement, the sterilization of parts which are threaded together is poor and it takes time to disassemble and assemble these parts, leading to a poor capability of maintenance. In addition, when the parts are connected together by threadable engagement, there remains a problem that the parts may become loosened.

OBJECT AND SUMMARY OF THE INVENTION

Accordingly, it is an object of the present invention to provide a liquid filling valve which provides an excellent sterilization capability and a high maintenance capability and which is free from the likelihood that the parts threaded together may become loosened.

Above object is accomplished by providing a liquid filling valve comprising a tubular nozzle having an internal filled liquid passage, an operating rod passing through the nozzle and driven up and down by elevating means, an opening/closing valve including a valve element disposed on the bottom end of the operating rod and a valve seat formed around the internal surface of the nozzle at its bottom end, the internal surface of the nozzle being formed at its top portion with a portion of a reducing diameter which gradually reduces the cross-sectional area of the filled liquid passage and a portion of an increasing diameter which is formed below the portion of a reducing diameter and which gradually increases the cross-sectional area of the filled liquid passage, the operating rod having a diameter which is less than an internal minimum diameter of the portion of a reducing diameter, and a plurality of axially extending straightening vanes mounted on the internal surface of the nozzle.

In the liquid filling valve according to the present invention, nothing is mounted on the external surface of the operating rod, but the straightening vanes are mounted on the internal surface of the nozzle, and since the external surface of the operating rod is chosen to be less than the internal diameter of the portion of a reducing diameter which is formed on the internal surface of the nozzle, the nozzle can be dismounted while the operating rod is mounted thereon. This facilitates a maintenance operation, and since the operating rod can be formed by an integral member without dividing it into several parts, there is no need of threadable engagement between parts, providing an excellent sterilization capability.

DETAILED DESCRIPTION OF PREFERRED EMBODIMENT

Figure 1:
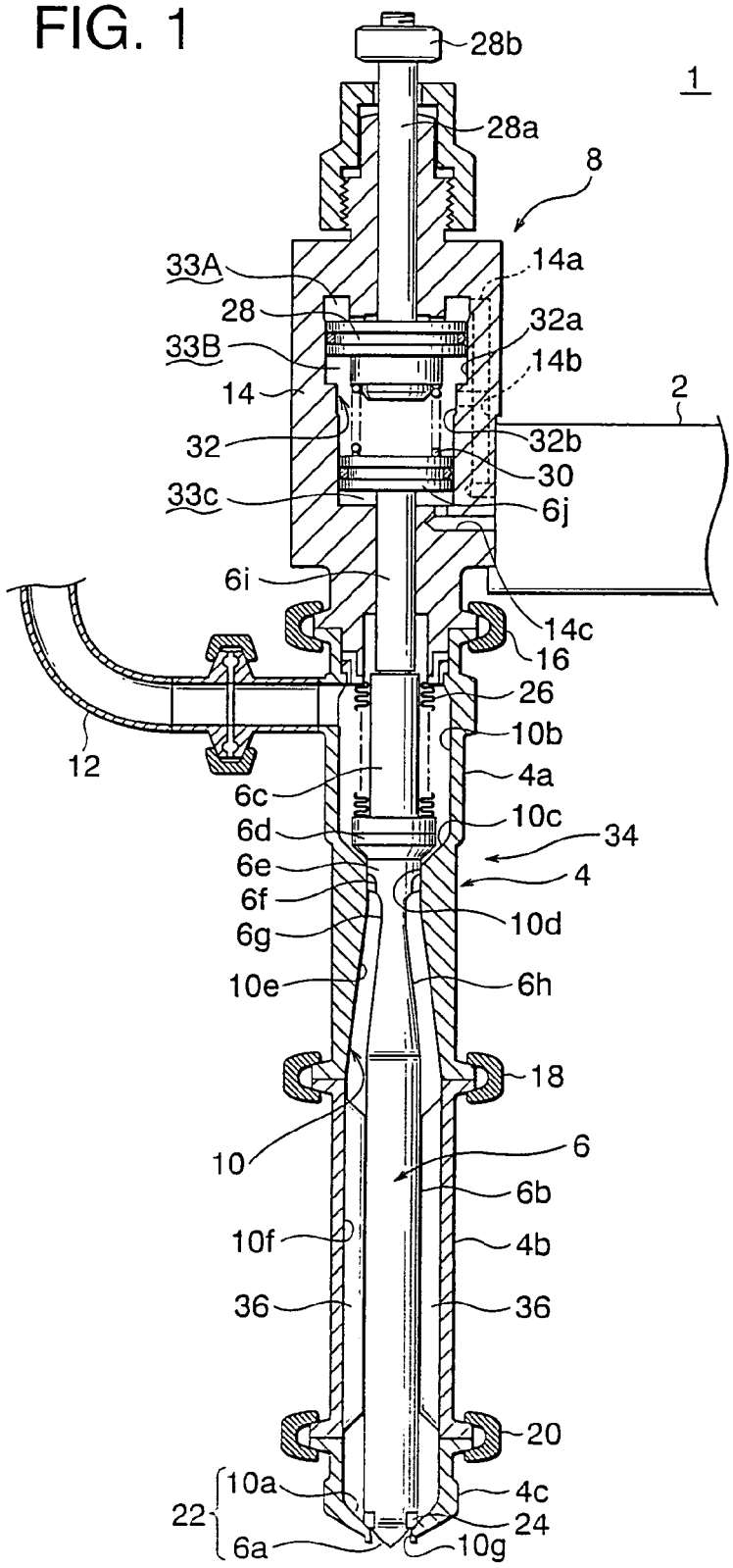
FIG. 1 is a longitudinal section of a liquid filling valve according to one embodiment of the present invention.

Referring to the drawings, an embodiment of the present invention will now be described. A liquid filling valve 1 according to one embodiment of the present invention is adapted to be mounted on the outer periphery of a revolving body 2, and in practice, a plurality of valves 1 are mounted at an equal spacing therebetween around the circumference. The liquid filling valve 1 comprises a tubular nozzle 4 and an operating rod 6 which passes through the tubular nozzle 4. The operating rod 6 has a top end which is connected to an air cylinder 8, and when the air cylinder 8 is actuated, the rod moves up and down within the nozzle 4. The interior of the tubular nozzle 4 defines a passage 10 for a filled liquid, and a filled liquid which is fed from filled liquid tank, not shown, is fed through a liquid feed pipe 12 which is connected to a sidewall of the upper end of the passage to flow down the filled liquid passage 10.

The tubular nozzle 4 is connected to the lower surface of a cylinder body 14 which is secured to the outer periphery of the revolving body 2. The tubular nozzle 4 comprises a plurality of tubular members 4*a*, 4*b* and 4*c*, and the cylinder body 14 and the plurality of tubular members 4*a*, 4*b* and 4*c* are connected together in a vertical column by fasteners 16, 18 and 20.

The internal surface of the tubular nozzle 4 or the filled liquid passage 10 is formed, toward its bottom end, with a tapered surface 10*a* which has a reducing diameter in a downward direction. On the other hand, the bottom end of the operating rod 6 is formed into a conical portion, and the tapered surface 10*a* formed at the bottom of the filled liquid passage 10 and acting as a valve seat and the conical portion 6*a* formed on the bottom end face of the operating rod 6 and acting as a valve element form together an opening/closing valve 22. An annular groove is formed in the outer periphery of the operating rod 6 in an area where the conical portion 6*a* meets with a solid cylinder (lower solid cylinder 6*b* which is formed above the conical portion) 6*b*, and an annular seal member 24 is fitted in the annular groove. More specifically, the seal member 24 which projects from the outer periphery of the conical portion 6*a* is in close contact with the valve seat (tapered surface) 10*a*.

The internal surface of the tubular nozzle 4 which forms the filled liquid passage 10 is formed with a circular opening 10*b* of a given internal diameter at its uppermost portion, and the liquid feed pipe 12 is connected with the circular opening 10*b*. The internal surface of the tubular nozzle 4 is formed with a portion 10*c* having an internal diameter which is gradually reduced in a downward direction at a location below the circular opening 10*b*. The internal surface of the tubular nozzle 4 is also formed with an opening 10*d* of a reduced diameter which is the same as the minimum diameter of the portion 10*c* and having a reduced vertical length at a location below and continuing from the portion 10*c*, and a portion 10*e* of an increasing diameter having an internal diameter which gradually increases in the downward direction at a location continuing from the opening 10*d*. It will be noted that the portion 10*c* of a reducing diameter has an internal diameter which changes rapidly and has a reduced vertical length. By contrast, the portion 10*e* of an increasing diameter has an internal diameter which changes gently and a vertical length which is greater than the length of the portion 10*c*.

The portion 10*e* of an increasing diameter is downwardly followed by a circular opening 10*f* having an increased vertical length and a constant internal diameter. The tapered surface 10*a* which defines the valve seat for the opening/closing valve 22 follows downwardly of the circular opening 10*f* having an increased length. An opening 10*g* which is formed at the bottom end of the tapered surface 10*a* defines a liquid pouring port through which a liquid to be filled into a vessel, not shown, flows. It is to be noted that the circular opening 10*f* having an increased length and the circular opening 10*b* of a reduced length which is located above and to which the liquid feed pipe 12 is connected have an equal internal diameter. However, it should be understood that the both circular openings 10*a* and 10*b* need not have an equal internal diameter, but may have different internal diameters.

On the other hand, the operating rod 6 which is passed through the tubular nozzle 4 has a top end 6*i* which extends through the bottom of the cylinder body 14 which is secured to the upper end of the tubular nozzle 4 into a cylinder chamber 32, and is formed with a head 6*j* at its upper end which fits in the internal surface of the cylinder chamber 32 at its bottom for sliding movement therein. The operating rod 6 includes a portion 6*c* which is disposed within the circular opening 10*b* located in the upper portion of the tubular nozzle 4 and has an external diameter which is slightly greater than the external diameter of the top end 6*i* which extends through the cylinder body 14. Bellows 26 is mounted around the portion 6*c* having a greater external diameter in order to prevent the ingress of contaminants which may be developed in the sliding portions into the filled liquid passage 10.

Below the portion 6*c* around which the bellows 26 is mounted, the operating rod 6 is formed with a portion 6*d* of an increased diameter where the lower end of the bellows 26 is mounted, and the portion 6*d* is followed by a solid cylinder 6*e* which defines a second valve element. The solid cylinder 6*e* has an external diameter which is slightly less than the internal diameter of the opening 10*d* (or the minimum internal diameter of the portion 10*c* of a reduced diameter) which is formed in the internal surface of the tubular nozzle 4, and when the solid cylinder 6*e* fits in the opening 10*d* of a smaller diameter, a very small clearance is formed between both members 6*e* and 10*d*. In this manner, a preseal 34 is formed by the solid cylinder 6*e* formed on the upper portion of the operating rod 6 and acting as the second valve element and the opening 10*d* of a reduced diameter which is formed in an upper portion of the internal surface of the nozzle 4. Notches 6*f* are formed at a plurality of locations in a lower portion of the solid cylinder 6*e* serving as the second valve element to form a passage for controlling the amount of the filled liquid which is injected into the vessel by controlling the vertical position of the operating rod 6 in accordance with the operation of the air cylinder 8, as will be further described later.

At a location below the solid cylinder (second valve element) 6*e*, the operating rod 6 is formed with a shank 6*g* of a reduced diameter which is downwardly followed by a conical portion 6*h* having an external diameter which gradually increases in a downward direction. In addition, the operating rod 6 is formed with the solid cylinder 6*b* having a constant external diameter and having a greater vertical length in a manner extending downwardly from the conical portion 6*h*. The conical portion 6*a* which defines the valve element of the opening/closing valve 22 is formed at the bottom end of the solid cylinder 6*b* having an increased length. The solid cylinder 6*b* has an external diameter which is slightly less than the internal diameter of the opening 10*d* of a reduced diameter.

The air cylinder 8 which drives the operating rod 6 up and down includes a piston, hereafter referred to as a first piston, 28 which is slidably fitted into the cylinder chamber 32 defined within the cylinder body 14, and a spring 30 is interposed between the lower surface of the piston 28 and the head 6*j*, hereafter referred to as a second piston, which is formed on the top end of the operating rod 6. The first piston 28 has a rod 28*a* which extends upward of the cylinder body 14, and a nut 28*b* is threadably engaged on the top end of the rod 28*a* for defining the descent position of the first piston 28.

The cylinder chamber 32 which is formed within the cylinder body 14 has an upper portion 32*a* of a greater diameter and a lower portion 32*b* of a smaller diameter. The first piston 28 is slidably fitted into the upper portion 32*a* while the second piston 6*j* is slidably fitted into the lower portion 32*b*. These pistons 28 and 6*j* divide the interior of the cylinder chamber 32 into an upper pressure chamber 33A, a middle pressure chamber 33B and a lower pressure chamber 33C.

Air passages 14*a*, 14*b* and 14*c* are connected to the upper, the middle and the lower pressure chamber 33A, 33B and 33C, respectively, which are defined by the pistons 28 and 6*j* for enabling air pressures to be introduced into or discharged from the pressure chambers 33A, 33B and 33C. When the air pressure is introduced into the middle pressure chamber 33B while the air pressure is discharged from the upper and the lower pressure chamber 33A and 33C, the operating rod 6 descends to close the opening/closing valve 22. When the air pressure is introduced into the lower pressure chamber 33C while the air pressure is discharged from the upper and the middle pressure chamber 33A and 33B, the operating rod 6 is upwardly raised to open the opening/closing valve 22, and the solid cylinder 6*e* is displaced upward of the opening 10*d*, thus allowing a filling operation at a greater flow rate to be performed. When the air pressure is introduced into both the upper and the lower pressure chamber 33A and 33C while the air pressure is discharged from the middle pressure chamber 33B, an upward stroke of the operating rod 6 can be reduced while opening the opening/closing valve 22, thus allowing a filling operation to be performed at a smaller flow rate through the notches 6*f*.

Figure 2:
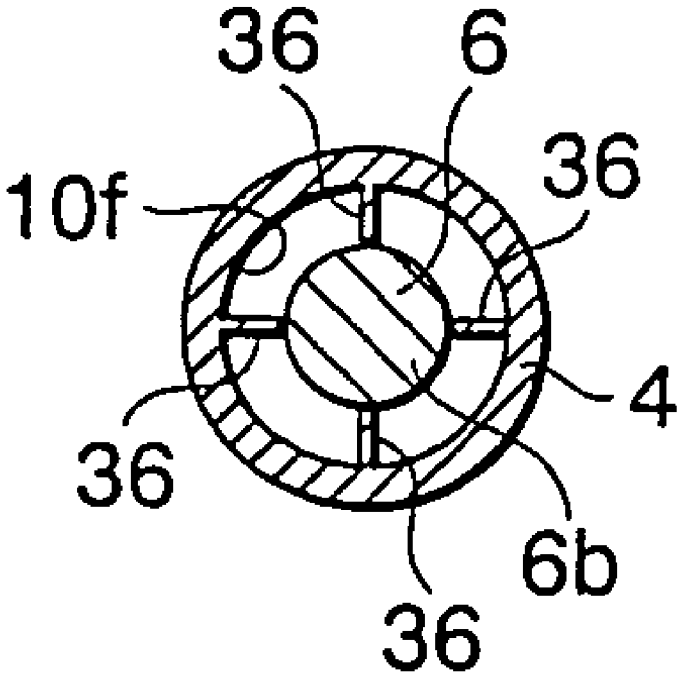
FIG. 2 is a transverse section of a lower portion of the liquid filling valve.

As shown in FIGS. 1 and 2, a plurality of straightening vanes 36, which are equal to four in number in this embodiment, extending parallel to the axis of the operating rod 6 and radially inward are formed on the internal surface of the circular opening 10*f* having an increased vertical length which is formed toward a lower portion of the tubular nozzle 4. The solid cylinder 6*b* having an increased vertical length formed in the lower portion of the operating rod 6 is disposed inside these straightening vanes 36. It will be noted that a circle which joins the inner ends of the straightening vanes 36 has an internal diameter which is slightly greater than the external diameter of the solid cylinder 6*b* of the operating rod 6, thus leaving a small clearance between the inner ends of the straightening vanes 36 and the outer peripheral surface of the operating rod 6. The straightening vanes 36 have a sufficient length in the axial direction of the operating rod 6 to allow the outer peripheral surface of the solid cylinder 6 to move up and down along the surfaces defined by the inner ends of the straightening vanes 36 during the elevating motion of the operating rod 6. A suitable number of straightening vanes 36 can be chosen, but a satisfactory straightening effect cannot be obtained with two vanes because of an increased spacing therebetween. Conversely, an excessive number of vanes block a flow of the liquid through the filled liquid passage 10, and accordingly, it is preferable to use three or four vanes.

A positional relationship between the opening/closing valve 22 which comprises the valve element disposed at the bottom end of the operating rod 6 (or the upper end of the conical portion 6*a* fitted with the seal member 24) and the valve seat (tapered surface) 10*a* at the bottom end of the internal surface of the tubular nozzle 4, and the preseal 34 which comprises the solid cylinder 6*e* formed on an upper portion of the operating rod 6 and acting as the second valve element and the opening 10*d* of a reduced diameter which is formed in a upper portion of the internal surface of the tubular nozzle 4 will now be considered. When the valve element 6*a* of the operating rod 6 is seated on the valve seat 10*a* formed on the internal surface of the nozzle 4 at the bottom end thereof, as shown in FIG. 1, the solid cylinder 6*e* formed in the upper portion of the operating rod 6 fits inside the opening 10*d* of a reduced diameter formed in the internal surface of the nozzle 4. Accordingly, as the operating rod 6 descends, the solid cylinder 6*e* of the preseal 34 begins to be fitted into the opening 10*d* before the valve element 24 is seated upon the valve seat 10*a*, thus substantially interrupting a flow of the filled liquid.

The operation of the liquid filling valve 1 constructed in the manner mentioned above will now be described. Before initiating a filling operation, the air pressure is supplied into the middle pressure chamber 33B through the air passage 14*b* while the air pressure is discharged from the upper and lower pressure chamber 33A and 33C, and accordingly, the operating rod descends to close the opening/closing valve 22. Under this condition, a liquid which is to be filled into a vessel, not shown, is fed to the filled liquid passage 10 from a filled liquid tank through the liquid feed pipe 12 which is connected to the upper end of the tubular nozzle 4.

The liquid filling valve 1 of this embodiment is designed such that a majority of the liquid filled such as 90% of the total content, for example, is filled at a high flow rate, and after the majority of the total content has been filled into a vessel, the filling operation is switched into a low flow rate to complete filling the remainder.

At the commencement of the filling operation, the air passages are switched such that the air pressure is supplied into the lower pressure chamber 33C through the air passage 14*c* while the air pressure is discharged from the upper and the middle pressure chamber 33A and 33B. When the air pressure is introduced into the lower pressure chamber 33C, the second piston 6*j* and the operating rod 6 begin to rise, and the valve element (conical portion) 6*a* formed at the bottom end of the operating rod 6 is initially removed from the valve seat (tapered surface) 10*a* formed on the inner surface of the tubular nozzle 4 at its bottom end, thus opening the opening/closing valve 22. At a point in time when the opening/closing valve 22 is opened to initiate a filling operation, the solid cylinder 6*e* and the opening 10*d* of the upper preseal 34 overlap each other, and accordingly a liquid which remains between the upper preseal valve 34 and the lower opening/closing valve 22 flows out of the liquid pouring port 10*g* to be filled, but because the pressure from the filled liquid which is fed from the liquid feed pipe 12 is not applied to the distal end of the nozzle 4, there is no rapid egression of the filled liquid, thus avoiding the likelihood that the filled liquid may be splashed around.

As the operating rod 6 continues to rise, the solid cylinder 6*e* formed in the upper portion of the operation rod 6 is displaced upwardly from the opening 10*d* formed in the internal surface of the nozzle 4, thus completely opening the preseal 34. Thereupon, the filled liquid which have been filled from the liquid feed pipe 12 to a location above the preseal 34 flows down through the preseal 34 into the filled liquid passage 10 and passes through the opening/closing valve 22 located at the bottom end of the nozzle 4 to be filled into the vessel.

When the filled liquid flows through the filled liquid passage in this manner, the liquid which flows into the filled liquid passage 10 formed within the nozzle 4 from the liquid feed pipe 12 that is connected to the upper end of the nozzle 4 in a lateral orientation revolves to form a vortical flow. The liquid which flows down the filled liquid passage 10 in a vortical flow rushes into the portion 10*c* of a reduced diameter which is located directly above the preseal 34. The channel area is rapidly reduced at the location of the portion 10*c*, whereby the liquid which rushes in this portion in a vortical flow is straightened to pass therethrough with an increased flow velocity to flow into the opening 10*d* of a reduced diameter which is disposed directly below it. The opening 10*d* of a reduced diameter is directly followed by the portion 10*e* of an increasing diameter which has a gradually increasing channel area. Accordingly, the liquid having its flow velocity increased at the portion 10*c* of a reduced diameter is decelerated as it flows through the portion 10*e*.

A primary straightening function is achieved at the portion 10*c* of a reducing diameter and the portion 10*e* of an increasing diameter. Subsequently, after the flow velocity has been decelerated, the filled liquid flows into the circular opening 10*f* having an increased vertical length which is formed below in the lower portion of the nozzle 4. The plurality of straightening vanes 36 are formed on the internal surface of the circular 10*f*, and the filled liquid which has been subjected to the primary straightening effect impinges upon these vanes, whereby a secondary straightening function is achieved. When the filled liquid is subject to two steps of straightening function, a vortical flow is completely removed therefrom to provide a smooth flow which is projected from the pouring port 10*g* to be filled into the vessel, thus preventing the occurrence of a liquid splash and a bubbling within the vessel.

When the filling operation at a high flow rate proceeds to a point such as 90% of the total content, for example, the air passages are switched so that the air pressure is introduced into the upper and the lower pressure chambers 33A and 33C from the upper and the lower air passages 14*a* and 14*c* while the air pressure is discharged from the medium pressure chamber 33B. As mentioned previously, the first piston 28 has a greater diameter than the second piston 6*j*, whereby the first piston 28 descends to a step formed between the upper and the lower portions 32*a* and 32*b* of the cylinder chamber 32, and the second piston 6*j* abuts against the first piston 28 where its rising movement is stopped.

Accordingly, the operating rod 6 assumes a position which is located somewhat lower than the position assumed during the filling operation at a high flow rate, and only a portion of the portion 6*e* of a reduced diameter where the notch is formed fits into the opening 10*d* of a reduced diameter which is formed in the tubular nozzle 4. A region located above the opening 10*d* or located toward the portion 10*c* and a region located below the opening 10*d* or located toward the portion 10*e* are connected together principally through the notches 6*f* formed in the operating rod 6, thus allowing a filling operation to be performed at a low flow rate.

When the liquid has been filled into the vessel to a predetermined content as a result of the filling operation at a low rate, the air passages 14*a*, 14*b* and 14*c* are switched again to terminate a filling operation. At the end of the filling operation, the air pressure is introduced into the middle pressure chamber 33B within the air cylinder 8 from the air passage 14*b*, thus causing the second piston 6*j* to descend the operating rod 6. As the operating rod 6 descends, the valve element 6*a* which is disposed at the bottom end thereof moves close to the valve seat 10*a* formed at the bottom of the nozzle 4 to throttle a flow channel to the pouring port 10*g* in a gradual manner, but before this occurs, the solid cylinder 6*e* disposed in the upper portion of the operation rod 6 fits into the opening 10*d* of a reduced diameter formed in the internal surface of the nozzle 4 to close the notches 6*f* gradually, and accordingly, there is no rapid increase in the flow velocity as the opening/closing valve 22 is closed, thus preventing a liquid splash or a bubbling when the filling operation is terminated. Subsequently, the operating rod further descends, and the valve element 6*a* becomes seated upon the valve seat 10*a* to close the opening/closing valve 22.

As mentioned, at the commencement of the filling operation, when the opening/closing valve 22 disposed in the lower portions of the tubular nozzle 4 and the operating rod 6 is opened or at the termination of the filling operation when the opening/closing valve 22 is closed, the preseal 34 which is disposed in the upper portion of the tubular nozzle 4 and the operating rod 6 assumes an overlapping condition, thus effectively preventing a liquid splash or a bubbling of the filled liquid which is projected from the liquid pouring port 10*g* disposed at the bottom end of the nozzle 4.

During the filling operation, the filled liquid which runs the filled liquid passage 10 in a vortical flow is subject to a primary straightening function, then has its flow velocity reduced by being passed through the portion 10*e* of an increasing diameter, then subjected to a secondary straightening function by the straightening vanes 36 to remove a vortex completely, whereupon the filled liquid is discharged through the liquid pouring port 10*g* disposed at the distal end of the nozzle 4, thus allowing the liquid to be filled into the vessel in a reliable manner without being splashed around. Since a liquid splash can be completely prevented during the filling operation, an above-the-mouth filling operation which allows the liquid to be filled into the vessel without inserting the distal end of the nozzle 4 into the vessel is possible, thus enabling a significant cost-reduction of a filler by dispensing with an elevating mechanism for the filling valve 1 and an elevating mechanism for a bottle carrier. The omission of an elevating mechanism makes the liquid filling valve suitable for use in an axenic filler or the like.

In the disclosed embodiment, the straightening vanes 36 are formed on the internal surface of the tubular nozzle 4 in distinction to a conventional arrangement in which the vanes 36 are mounted on the external surface of the operating rod 6. The entire thickness of the operating rod 6 can be chosen to be less than the minimum diameter of the portion 10*c* of a reduced diameter (same as the diameter of the opening 10*d* of a reduced diameter) of the nozzle 4, whereby it is possible to withdraw the tubular nozzle 4 without disassembling the operating rod 6 from the air cylinder 8, improving the maintenance capability. Because the operating rod 6 comprises an integral member, there are no parts which are threaded together, affording an excellent sterilization capability. There is no concern about a loosening of parts which are threaded together.

What is claimed is:

1. A liquid filling valve comprising a tubular nozzle having an internal filled liquid passage, an operating rod passing through the nozzle and driven up and down by elevating means, an opening/closing valve formed by a valve element formed on the bottom end of the operating rod and a valve seat formed on the internal surface of the nozzle at its bottom end, a portion of a reducing diameter formed on the internal surface of the nozzle in an upper portion thereof and gradually reducing the cross-sectional area of the filled liquid passage, and a portion of an increasing diameter which is disposed below the portion of a reducing diameter for gradually increasing the cross-sectional area of the filled liquid passage, wherein the operating rod has a diameter which is less than a minimum internal diameter of the portion of a reducing diameter and a plurality of axially extending straightening vanes are formed on the internal surface of the nozzle.

2. A liquid filling valve according to claim 1 in which the straightening vanes are disposed to be parallel to the axis of the operating rod.

3. A liquid filling valve according to claim 1, further including a preseal which is capable of substantially interrupting a downward flow of the filled liquid before the opening/closing valve is closed.

4. A liquid filling valve comprising a tubular nozzle having an internal filled liquid passage, an operating rod passing through the nozzle and driven up and down by elevating means, an opening/closing valve formed by a valve element formed on the bottom end of the operating rod and a valve seat formed on the internal surface of the nozzle at its bottom end, a portion of a reducing diameter formed on the internal surface of the nozzle in an upper portion thereof and gradually reducing the cross-sectional area of the filled liquid passage, a portion of an increasing diameter which is disposed below the portion of a reducing diameter for gradually increasing the cross-sectional area of the filled liquid passage and a preseal which is capable of substantially interrupting a downward flow of the filled liquid before the opening/closing valve is closed, the preseal comprising a solid cylinder formed in an upper portion of the opening rod and an opening of a reduced diameter formed on the internal surface of the nozzle at an upper portion thereof, the solid cylinder having passages formed in its lower portion which permit the filled liquid to pass therethrough, wherein the operating rod has a diameter which is less than a minimum internal diameter of the portion of a reducing diameter and a plurality of axially extending vanes are formed on the internal surface of the nozzle.

* * * * *